US005633224A

United States Patent [19]

Porter

[11] Patent Number: 5,633,224

[45] Date of Patent: May 27, 1997

[54] LOW PH GRANULAR DETERGENT COMPOSITION

[75] Inventor: Terrence J. Porter, Cincinnati, Ohio

[73] Assignee: The Procter & Gamble Company, Cincinnati, Ohio

[21] Appl. No.: 465,175

[22] Filed: Jun. 22, 1995

Related U.S. Application Data

[63] Continuation-in-part of Ser. No. 274,873, Jul. 14, 1994, abandoned.

[51] Int. Cl.[6] ..... C11D 3/065

[52] U.S. Cl. ..... 510/444; 510/359

[58] Field of Search ..... 252/89.1, 135, 252/531, 174, 136; 510/444

[56] References Cited

U.S. PATENT DOCUMENTS

| | | | |
|---|---|---|---|
| 4,007,124 | 2/1977 | Collier et al. | 252/109 |
| 4,019,998 | 4/1977 | Benson et al. | 252/135 |
| 4,170,453 | 10/1979 | Kitko | 8/111 |
| 4,560,492 | 12/1985 | Curry et al. | 252/110 |
| 4,645,616 | 2/1987 | Niven et al. | 252/135 |
| 4,707,287 | 11/1987 | Herdeman | 252/91 |
| 4,715,979 | 12/1987 | Moore et al. | 252/91 |
| 4,810,413 | 3/1989 | Pancheri et al. | 252/174.12 |
| 4,869,843 | 9/1989 | Saito et al. | 252/135 |
| 5,282,996 | 2/1994 | Appel et al. | 252/100 |

FOREIGN PATENT DOCUMENTS

| | | | |
|---|---|---|---|
| 0242138B1 | 9/1991 | European Pat. Off. | C11D 3/10 |
| 2559-631 | 10/1974 | Germany . | |
| 5-4149-707 | 5/1978 | Japan . | |
| 5-4160-405 | 6/1978 | Japan . | |
| 6-2004-794-A | 7/1985 | Japan . | |
| 2106482A | 4/1983 | United Kingdom | C01D 7/00 |
| WO91/17232 | 11/1991 | WIPO | C11D 1/28 |
| WO91/17234 | 11/1991 | WIPO | C11D 3/02 |
| WO92/06170 | 4/1992 | WIPO | C11D 11/04 |
| WO95/00630 | 1/1995 | WIPO | C11D 17/06 |
| WO95/02673 | 1/1995 | WIPO | C11D 3/30 |
| WO95/10595 | 4/1995 | WIPO | C11D 17/06 |

*Primary Examiner*—Margaret Einsmann

*Attorney, Agent, or Firm*—D. F. Nesbitt; D. E. Hasse; J. C. Rasser

[57] ABSTRACT

A high density granular detergent composition having a pH (1% in distilled water) of from about 9.0 to about 10.0, that contains from 5% to about 50% anionic detergent surfactant and from about 3% to about 40% acid pyrophosphate is disclosed. The composition is formed by agglomeration of the acid pyrophosphate and a portion of the surfactant, preferably in a V-blender. The composition contains less than about 1%, but preferably is free of, citric acid.

7 Claims, No Drawings

LOW PH GRANULAR DETERGENT COMPOSITION

This is a continuation-in-part of application Ser. No. 08/274,873, filed on Jul. 14, 1994 now abandoned.

FIELD OF THE INVENTION

The present invention relates to laundry detergent composition having a low pH. Such granular detergent compositions comprise acid pyrophosphate agglomerated with the detergent surfactant to minimize segregation during processing, storage, and use.

BACKGROUND OF THE INVENTION

Reduced-pH granular detergent compositions are known, and can have a pH of less than about pH 10. Low pH compositions offer the advantage of being less harsh to skin, reduced color fading, and in certain cases, improved stain removal. Examples of such compositions are disclosed in Japanese Patent Laid-Open S54-160405, (Ajinomoto), Dec. 19, 1979; Japanese Patent Laid-Open S54-149707, (Lion) Nov. 24, 1979; German Patent publication 2,559,631 (Henkel) May 18, 1977; U.S. Pat. No. 4,707,287, (Herdeman) Nov. 17, 1987; Japanese Patent Laid-Open S62-4794, (Kao Soap) Jan. 10, 1987; U.S. Pat. No. 4,170,453, (Procter & Gamble Company) Oct. 9, 1979; U.S. Pat. No. 4,810,413, (Pancheri et al) Mar. 7, 1989; GB Patent 2,106,482 (Kaeser); and Mexican Patent 172,329, (Leslie et al) Dec. 13, 1993.

To achieve the reduced pH of the compositions of the above references, it is disclosed to utilize, from among a variety of acidic materials, a weak acid material such as citric acid, or a half-salt such as sodium acid pyrophosphate. Both of these ingredients also serve as a builder; that is, a material that can sequester calcium and magnesium ions (often called "hardness") in the wash water.

Acid pyrophosphate can form a hydrate, and lose this water of hydration at a temperature above about 80° C. For this reason, it is preferred to avoid exposing the acid pyrophosphate hydrate to temperatures above 80° C., such as to temperatures achieved routinely in a conventional spray-drying operation, which are well known to those skilled in the art. In such operation, detergent ingredients, both liquid and dry forms, are formed together into a slurry which is then introduced into a counter-current spray-drying tower, thereby forming a spray-dried product.

Alternatively, such acid builder materials are preferentially admixed with spray-dried granules. More preferably, however, such acid builders are processed into a product using only low-temperature agglomeration processes. Such processes include the V-blender process disclosed in WO-92-6170 (The Procter & Gamble Company), Apr. 16, 1992, the disclosure of which is incorporated herein by reference. Such processes can also include agglomeration processes using other well known equipment such as the Littleford mixer or Lodige mixer, as described in co-owned and co-pending applications U.S. Ser. No. 08/92048 (Capeci et al.), filed Oct. 15, 1993, Attorney Docket No. 5043; U.S. Ser. No. 08/137,877 (Pancheri), filed Jul. 15, 1993, Attorney Docket No. 4952; and U.S. Ser. No. 08/83,145 (Welch et al.), filed Jun. 25, 1993, Attorney Docket No. 4921. Such processes provide intimate incorporation of the acid builder into the base granular material (that is, the material comprised of the detergent surfactant and optionally other detergent builders).

However, such disclosures, while teaching the preferred use of citric acid as the acid builder, fails to recognize the deliquescent nature of citric acid which is detrimental to the physical stability of the product containing the citric acid, particularly in hot and humid conditions which are common in most parts of the world. By deliquescent is meant that the citric acid forms a hydrate from moisture and then proceeds to dissolve in its own water of hydration. In granular detergent products, if such deliquescing occurs when the citric acid is admixed, or agglomerated, with the base granular material, the product becomes lumpy, cakey, and pours poorly, if at all.

The present invention then is the discovery that substantially improved low pH detergent products can be formed by using a low acidic material or a half-acid material, preferably a builder, such as acid pyrophosphate, and that maintains a stable hydrate below temperatures of about 90° C., and by avoiding or minimizing the use of such acid builders which have hydrates that are not stable below about 50° C., or which are deliquescent, such as citric acid. Such products have substantially improved physical properties and, when formed using an agglomeration process, resist segregation of the acid builder material from the base detergent material.

DETAILED DESCRIPTION OF THE INVENTION

The present invention is to a granular detergent composition having high density, preferably greater than a density of 600 gm/liter, and having a solution pH (1% of the composition dissolved in distilled water) of from about 9.0 to about 10.0, more preferably from about 9.2 to 9.7. The composition comprises by weight: (i) from 5% to about 50% detergent anionic surfactant; (ii) from about 3% to about 40%, preferably from about 5% to about 40%, acid pyrophosphate; and (iii) less than about 1% of citric acid or salt thereof. The composition is formed by agglomeration of said acid pyrophosphate along with a portion of said detergent surfactant.

The detergent surfactant is preferably at a level from about 5% to 30% by weight. The anionic surfactant can be selected from linear or branched chain alkyl benzene sulfonate having an C8–20, preferably C10–18 alkyl chain; alkyl sulfate having a C8–20, preferably C14–18, alkyl chain; alkyl ether sulfate of the formula R-En-SO3M, wherein R is C8–20, preferably C12–18, alkyl chain, E is an ethoxy unit, n is from 0–20, and M is a suitable cation, preferably sodium ion; alpha-sulfonated fatty acid alkyl ether surfactant of the formula R'—C(SO3)H—C(O)—OR", wherein R' is C8–20, most preferably C18–18, alkyl chain, and R" is C1–C4 alkyl, preferably methyl; and mixtures thereof.

The acid pyrophosphate is preferably used at a level of from about 3% to 25%, more preferably from about 5% to 25%, most preferably from about 10% to 20%. An amount of acid pyrophosphate, as it is a half-acid material, is added to achieve a wash solution pH which is desired for detergency, or fabric conditioning or care purposes. The desired pH can be achieved by adjusting the levels of acid pyrophosphate as well as other acidic, alkaline and buffering components in the formulation.

The acid pyrophosphate can be anhydrous or hydrated, preferably hydrated, and is preferably in particulate form. Most preferably, the acid pyrophosphate is processed in to the composition by an admix and/or agglomeration. Preferably, the composition is made such that the acid pyrophosphate does not dissolve substantially at any step of the process. Most preferably, the detergent composition or base component material thereof comprising the particulate acid pyrophosphate does not exceed a temperature of greater than 90° C., and preferably no greater than about 80° C.

In a preferred embodiment as described in the example, the acid pyrophosphate is admixed and effectively agglomerated with the surfactant component or base detergent material to form the detergent composition. This prevents the particulate acid pyrophosphate from readily segregating during the production, packaging, shipping, storage, handling or use of the detergent product. Since most granular detergent compositions are sold in packages or cartons which are intended to hold multiple usages of the detergent composition, any segregation can result in variability in the amount of acid pyrophosphate used in a wash treatment during the use of the detergent composition. By agglomerating the particulate acid pyrophosphate with the surfactant or base detergent component, segregation thereof is significantly reduced. The acid pyrophosphate typically has a particle size ranging from 50 microns to about 1500 microns, with a weight average particle size from about 100 microns to about 800 microns, preferably from about 100 microns to about 300 microns.

Agglomeration of the acid pyrophosphate with the anionic surfactant also results in better granule physical properties than when the acid pyrophosphate is simply admixed with anionic surfactant-based particles. While not intending to be limited by theory, it is believed that the acid pyrophosphate particles help coat the normally sticky surfactant particles during the agglomeration process, reducing their stickiness and enhancing granule flowability. The resulting granules are easier to process in the manufacturing plant and better maintain their flowability when used by the consumer.

The weight ratio of the anionic surfactant to acid pyrophosphate in the agglomerate is preferably about 0.5:1 to about 12:1, more preferably from about 0.75:1 to about 10:1, and most preferably from about 1:1 to about 10:1.

In a preferred means of forming the agglomerate, it is preferred to employ at least a portion of the anionic surfactant. Such portion can be the anionic surfactant itself in a liquid form (melted or dissolved partially or completely in water), or can be in the form of the liquid acid precursor of said anionic surfactant. In the example embodiment, it is shown that preferably the acid precursor portion of the anionic surfactant is alkyl benzene sulfonic acid, which is sprayed onto a fluidized mixture of the acid pyrophosphate and an inorganic alkaline material. Such process is often referred to as dry neutralization of the anionic surfactant from its acid precursor.

The inorganic alkaline material can be alkali metal (preferably sodium) carbonate, sodium tripolyphosphate, sodium pyrophosphate, alkali metal (preferably sodium) bicarbonate, and mixtures there. Alkali metal carbonate is most preferred. Sodium tripolyphosphate and sodium pyrophosphate, and mixtures thereof, are preferably used in combination with alkali metal carbonate to serve as effective builders.

The detergent composition also contains less than about 1% of citric acid, or salt thereof, and more preferably is essentially free of any citric acid. The detergent composition should also be essentially free of any other builder or alkaline material which forms a hydrate that looses the hydrate water at a low (less than about 50° C.) temperature, or (like citric acid) that forms a hydrate which deliquesces. While citric acid is a well-known and often used component of detergent compositions, especially low pH compositions, and provides both pH adjustment and builder capacity, its use in the present invention is intentionally minimized, and preferably eliminated.

In a preferred process for making the composition of the present invention, the granular detergent composition is made by the steps of:

a) forming a particulate mixture comprising a water-soluble alkaline inorganic material and said acid pyrophosphate;

b) mixing and shearing the particulate mixture such that the mixture is partially fluidized; and c) dispersing the acid precursor of the anionic surfactant into the partially fluidized particulate mixture, thereby neutralizing the acid precursor to form the detergent composition.

If the anionic surfactant comprises a portion consisting of alkyl sulfate, alkyl ether sulfate, alpha-sulfonated fatty acid alkyl ether surfactant, or any other pH sensitive surfactant, it is preferred that such portion be added into and agglomerated as a particulate surfactant. As used herein, a pH sensitive surfactant is one which can undergo undesirable hydrolysis under acidic conditions of less than about pH 6 and in the presence of moisture, or under alkaline conditions, particularly above about pH 9. In the particulate form, such hydrolysis is substantially minimized. Such process is disclosed and claimed in WO-92-6170 (The Procter & Gamble Company), Apr. 16, 1992. In a most preferred embodiment, the pH sensitive surfactant is alkyl sulfate. The portion of the anionic surfactant added as a particulate in such manner can range from 5% to 90%, depending upon the total amount of surfactant employed, and the desired amount of alkyl sulfate (or other pH sensitive surfactant) used.

Such process of dry neutralizing the acid precursor of the anionic surfactant in the presence of the inorganic alkaline material and the acid pyrophosphate component can be conducted in any of a number of well-known equipment. Such equipment can include the well-known Lodige mixer, Littleford mixer, and V-blender mixer, or any multiple or combination thereof. Preferred is a V-Blender equipment. In such process, in order to prevent loss of the water of hydration from the acid pyrophosphate, and to minimize the hydrolysis of any pH sensitive surfactant present, it is preferred to maintain the temperature of the detergent composition during processing at a temperature of no more than about 90° C., preferably no more than about 80° C.

Optional Ingredients

A detergent builder is used for cleaning performance and is preferably selected from sodium tripolyphosphate, tetra sodium pyrophosphate, alkali metal aluminosilicate, and mixtures thereof. The most preferred builder is sodium tripolyphosphate. The aluminosilicates can be crystalline or amorphous in structure and can be either naturally occurring or synthetically derived. Preferred synthetic crystalline aluminosilicate ion exchange materials useful herein are available under the designations Zeolite A, Zeolite B, and Zeolite X. In an especially preferred embodiment, the crystalline aluminosilicate ion exchange material is Zeolite A and has the formula:

$$Na_{12}[(AlO_2)_{12}\cdot(SiO_2)_{12}].xH_2O$$

wherein x is from about 20 to about 30, especially about 27.

The water-soluble alkaline inorganic material can be alkali metal carbonate or alkali metal bicarbonate, though preferably sodium carbonate, potassium carbonate, lithium carbonate, and mixtures thereof; and most preferably, sodium carbonate.

Other ingredients commonly used in detergent compositions can optionally be incorporated into the granular detergent compositions of the present invention. The following are representative of such materials, but are not intended to be limiting.

Auxiliary surfactants include water-soluble salts of the higher fatty acids (i.e., "soap"); sodium alkyl glyceryl ether sulfates, especially those ethers of higher alcohols derived from tallow and coconut oil; sodium coconut oil fatty acid monoglyceride sulfonates and sulfates; and sodium or potassium salts of alkyl phenol ethylene oxide ether sulfates; water-soluble nonionic synthetic surfactant, broadly defined as a compound produced by the condensation of ethylene oxide (hydrophilic in nature) with an organic hydrophobic compound, which may be aliphatic or alkyl aromatic in nature; water-soluble amine oxides, water-soluble phosphine oxide surfactants, water-soluble sulfoxide surfactants, ampholytic surfactants which include aliphatic derivatives of heterocyclic secondary and tertiary amines, zwitterionic surfactants which include derivatives of aliphatic quaternary ammonium, phosphonium and sulfonium compounds, water-soluble salts of olefin sulfonates, and beta-alkyloxy alkane sulfonates.

The foregoing auxiliary surfactants can be used separately, or in mixtures of surfactants, at levels of from about 2% to about 30% by weight of the detergent composition.

A hydrotrope, or mixture of hydrotropes, can be present in the detergent granules. Preferred hydrotropes include the alkali metal, preferably sodium, salts of toluene sulfonate, xylene sulfonate, cumene sulfonate, and sulfosuccinate. The hydrotrope is preferably present at from about 0.5% to about 5% by weight of the detergent granules.

Auxiliary detergent builders which can be used include alkali metal (e.g., sodium and potassium) bicarbonates and silicates, and water-soluble organic detergency builders, for example alkali metal ammonium and substituted ammonium polycarboxylates. Specific examples of useful polycarboxylate builder salts include sodium, potassium, ammonium and substituted ammonium salts of ethylenediaminetetraacetic acid, nitrilotriacetic acid, oxydisuccinic acid, mellitic acid, benzene polycarboxylic acid, polyacrylic acid, polymaleic acid, and copolymers of acrylic and maleic acid.

Another useful optional component of the detergent granules is silicate, especially sodium silicate. Sodium silicate can be used at up to about 10% silicate solids having a weight ratio of $SiO_2$ to $Na_2O$ between about 1.6:1 and about 3.4:1. However, alkali metal silicates have a higher pH than the about 9 to 10 range (1% in distilled water) required for the present compositions. Alkali metal silicates also tend to absorb moisture from the environment and agglomerate with other ingredients in the detergent composition. This may result in the detergent becoming lumpy and having poor solubility in the wash water, particularly if the silicate is present during the agglomeration of the acid pyrophosphate and the anionic surfactant. Thus, if present in the detergent compositions of the invention, alkali metal silicates preferably represent less than about 3%, more preferably less than about 2%, by weight of the composition. Most preferably, the present compositions are substantially free of alkali metal silicates.

Sodium sulfate is a well-known material that is compatible with the compositions of this inventions. It can be a by-product of the surfactant sulfation and sulfonation processes, or it can be added separately.

Other optional ingredients include soil suspending agents such as water-soluble salts of carboxymethylcellulose and carboxyhydroxymethylcellulose, polyethylene glycol having a molecular weight of about 400 to 10,000, bleaches and bleach activators, enzymes, clays, soil release agents, dyes, pigments, optical brighteners, germicides, and perfumes.

The Agglomeration Process

A preferred process for making the granular detergent composition according to the present invention comprising the steps of:

a) forming a particulate mixture comprising a water-soluble alkaline inorganic material and said acid pyrophosphate;

b) mixing and shearing the particulate mixture such that the mixture is partially fluidized; and c) dispersing the acid precursor of the anionic surfactant into the partially fluidized particulate mixture, thereby neutralizing the acid precursor to form the detergent composition.

In step a), the particulate acid pyrophosphate is mixed with a water-soluble alkaline material and other optional dry, particulate components.

The preferred particulate water-soluble alkaline inorganic material is carbonate, preferably sodium carbonate. The amount of alkaline inorganic material added in the process for making the granular detergent composition will also include that amount necessary to neutralize the acid precursor which is added in Step c). The particulate carbonate used can vary from a powdered form having particles ranging from about 5 microns to about 100 microns, with a weight average particle size of from about 20 microns to about 60 microns, to a granular form having particles ranging from about 100 microns to 1500 microns with a weight average particle size of from about 300 microns to about 800 microns. The particular type of carbonate selected will effect the rate of neutralization, the size of the detergent granule formed in the process, and the stickiness and tackiness of the detergent granules. For example, the use of a more granular (larger particle size) carbonate material may result in slower neutralization, generally larger detergent granules with a higher amount of course material that may need to be further reduced in size or screened from the product, and relatively lower levels of anionic surfactant precursor acid loading, as compared to a fine powdered carbonate. Typically, higher levels of the acid precursor can be employed using a fine powdered carbonate. It is within the skill of workers in the art to select the appropriate type or mixtures of carbonate stock to achieve the desired surfactant level and product particle size.

In addition to the acid pyrophosphate, the particulate composition in Step a) preferably includes a hydratable inorganic detergent builder in particulate form. The hydratable inorganic detergent builder is preferably selected from sodium tripolyphosphate, tetra sodium pyrophosphate, sodium carbonate, alkali metal alumina silicate, and mixtures thereof. The most preferred hydratable builder is sodium tripolyphosphate. An important property of this material is its ability to hydrate free moisture, which may be generated during the neutralization of the alkylbenzene sulfonic acid. This can help to prevent excessive free moisture buildup in the process which may lead to caking and dough formation. The hydratable builder stock may range from a powdered form to a granular form in the particle size of the hydratable builder can effect the processing and the resultant product quality in the same manner as with the particle size of the carbonate material. Again, it is within the skill of workers in the art to select the appropriate type or mixtures of hydratable builder stock to achieve the desired product quality.

Additional detergent components, as described earlier, can be incorporated into the process in Step a). Preferably, these components are dry or contain low levels of free water to avoid the problems associated with the free water as described above.

A neutralization additive can optionally be employed in Step a) of the process. The additive is selected from sodium hydroxide, potassium hydroxide, lithium hydroxide, and mixtures thereof, and most preferably, sodium hydroxide. The neutralization additive is usually introduced in Step a) in the form of an aqueous solution (for example, 50% aqueous NaOH) at a level (anhydrous basis) from about 0.1% to about 1.0% by weight of the detergent granules. The neutralization additive helps to increase the initial rate of neutralization of the acid precursor with the carbonate, and is particularly useful in the neutralization of branched chain alkylbenzene sulfonic acid.

Water, including the water introduced with the neutralization additive, can help to promote reaction of the acid precursor with the neutralizing agent. However, in order to ensure that the product of the neutralization step remains in a particulate, free-flowing form, the amount of free water present in the particulate composition during the neutralization and in the final detergent granules is kept low, generally less than about 10% water, and typically from about 1% to 3% water, by weight of the detergent granules. Free water includes the water bound as water of hydration to inorganic materials which can release water of hydration at temperatures less than about 85° C.

The incorporation of the hydratable inorganic detergent builder and the low level of free water during the neutralization process help avoid excessive caking and dough formation, and prevent excessive agglomeration of the product so that further particle size reduction is unnecessary, though optional. The low moisture level also helps to prevent the acid-catalyzed hydrolysis of any pH sensitive detergent surfactant that is present.

The various components of the particulate composition of Step a) can be pre-mixed and metered together into the mixing and shearing equipment, or they can be individually metered into the equipment.

Step b) is the mixing and shearing of the particulate components so that the particulate composition is partially fluidized. The mixing in Step b) includes both any pre-mixing of the particulate composition before the addition of the acid precursor, as well as continuous mixing during the addition of the acid precursor in step c). In step b), the preomixing of the particulate composition can take from 30 seconds to about 5 minutes, preferably from 30 seconds to about 3 minutes. The pre-mixing ensures that the ingredients of the particulate composition, most importantly the alkaline inorganic material, are well blended prior to the addition of the acid precursor. During the pre-mixing, the input of energy due to the mixing and shearing can raise the temperature of the particulate composition by about 1° C.

The equipment selected to mix and shear the particulate composition is preferably capable of providing thorough mixing in order to prepare and maintain a homogeneous particulate composition dudng the neutralization reaction. The equipment is preferably capable of fluidizing the particulate composition in the vicinity where the acid precursor is dispersed. As used herein, the term "fluidize" means the state of mechanical agitation where the mass of particles to some extent become aerated, but does not require the use of any fluid or gas to provide such aeration. The preferred equipment for use in the process of this invention is the V-Blender (Patterson-Kelly, East Stroudsburg, Pa., USA). V-Blenders are commercially available in a variety of sizes, from a small laboratory unit (8-quart or 7 liters) to production sized units (50-ft$^3$ (1400 liter) and larger). Particularly preferred is the 50-ft$^3$ (1400 liter) V-Blender. The operation of the V-Blender will be discussed hereinafter.

Step c) is the dispersing of an acid precursor into the partially fluidized particulate composition, resulting in the essentially complete neutralization of the acid precursor to form the corresponding anionic surfactant, and in the formation of the granular detergent composition.

Alkylbenzene sulfonic acid is the highly preferred acid precursor. The alkylbenzene sulfonic acid material can contain from about 85% to about 98% sulfonic acid active, from about 0.5% to about 12% sulfuric acid, and from about 0% to about 5% water. The presence of some water in the alkylbenzene sulfonic acid can promote the neutralization of the acid by the alkaline inorganic material.

Dispersion of the acid precursor into the partially fluidized particulate composition can be achieved by a number of means, such as a two fluid (acid solution and gas) spray nozzle, a single fluid (acid solution only) spray nozzle, or a spinning disk atomizer. The spray or atomization conditions and acid precursor conditions (including temperature and spray-on rate) are selected to achieve effective atomization of the acid precursor into fine droplet. Effective atomization insures essentially complete neutralization of the acid precursor by the alkaline inorganic material without excessive buildup of non-neutralized acid in the reaction mixture or on the internal surfaces of the apparatus. Large non-neutralized acid precursor droplets can serve as an agglomerating agent and lead to unacceptably large detergent particles Also the presence of significant amounts of non-neutralized acid precursor in the reaction mixture of the particulate composition can accelerate the hydrolysis of any pH sensitive detergent surfactant active, as discussed earlier.

A preferred process utilized the 50-ft$^3$ (1400 liter) V-Blender apparatus described above. This is a twin shell blender with two simple cylinders formed to shape a "V". The shell is filled with particulate and/or powder from about 40% to 70% of the total volume. The shell rotates slowly around a center axis mid-way up the "V", thereby tumbling the particulate product, splitting it, and recombining it. Generally the V-Blender will be operated at a shell rotation speed of about 10 revolutions per minute (RPM) to about 35 RPM. In the 50-ft$^3$ V-Blender, the preferred rotation speed ranges from 12 RPM to 15 RPM.

An intensifier bar rotates through the center axis inside the V-Blender. The intensifier bar provides for good atomization of the acid precursor and for fluidization of the acid pyrophosphate in the vicinity of the dispersed detergent acid. The intensifier bar is hollow with two or more dispersion disks with blades attached along its length, and rotates at high blade tip speed (3000 ft/min to 5000 ft/min, or 914 meter/min to 1524 meter/min). The acid precursor is added through the intensifier bar and exits from the dispersion disks as fine droplets due to centripetal force. Droplet size and rate can be controlled to some extent by adjusting the shim gap of the intensifier dispersion disks. The intensifier bar mechanically fluidize the tumbling particulate composition in the vicinity of the dispersed alkylbenzene sulfonic acid. The result is an unimpeded dispersion of the acid with the fluidized powders and good liquid-powder contact.

The addition and dispersion of the acid precursor into the particulate composition will generally take from about 5 minutes to about 100 minutes for each batch of granular detergent composition made, depending on the type and size of equipment selected, the amount of acid used, and other factors. For the 50-ft$^3$ (1400 liter) V-Blender, the addition and dispersion will take from 8 minutes to 50 minutes, preferably from about 10 minutes to about 35 minutes. During this time, the reaction mixture, which includes the initial components of the particulate composition as well as the resulting detergent granules formed during the neutralization of the alkylbenzene sulfonic acid, will experience a temperature rise of about 20°–70° C. Some amount of heat can also be generated as the inorganic detergent builder is hydrated by the free water formed as a result of the neutralization reaction. So long as the level of free moisture in the reaction mixture remains low (e.g., less than about 10%), and so long as the acid precursor is well dispersed and is neutralized without excessive buildup in the product mixture, reaction mixture temperatures up to about 80° C. are acceptable.

After the complete addition of the acid precursor, other optional detergent materials can be added to the resultant detergent granules. Such materials can include a free flow aid such as crystalline or amorphous alkali metal aluminosilicate, calcium carbonate, and mixtures thereof. The free flow aid can be most effective when added immediately after the neutralization of the sulfonic acid, which allows the mixer to uniformly disperse it in the product. The free flow aid can optionally be added with the particulate composition of Step a). The free flow aid can be added at a level of from 0% to 20%, preferably from 2% to 10%, by weight of the detergent granules.

Other optional materials include perfume, bleach and bleach activator, softening clay, enzymes etc., which are preferably added to the detergent granules after the detergent granules have been discharged from the apparatus and cooled or allowed to cool to a temperature of approximately 40° C. or less.

The optional materials can be incorporated into the process at any suitable stage depending on their form, and a person skilled in this art will not have any difficulty in determining whether the ingredient can be incorporated into the neutralization step, or should be added to the product after the formation of the detergent granules.

The granular detergent composition made by this process generally has a weight average particle size of from about 100 microns to about 1500 microns, with a mean particle size of from about 300 microns to about 700 microns, and a bulk composition density of from about 600 g/l (grams per liter) to about 1000 g/l, most preferably from about 700 g/l to about 900 g/l. The individual detergent granules themselves made by this process have a particle density from about 1200 g/l to about 2000 g/l, most preferably from about 1400 g/l to about 1800 g/l. The individual particle density and the bulk composition density are significantly higher than those of detergent granules and granular detergent compositions made by the conventional spray drying process, which typically have a bulk density from about 250 g/l to about 500 g/l, and an individual particle density from about 500 g/l to 1000 g/l.

The invention is illustrated by the following non-limiting examples. All parts and percentages herein are by weight unless otherwise stated.

EXAMPLE I

A 230 kg batch of a high bulk density granular detergent was prepared. The final compositions are:

| | | Weight % |
|---|---|---|
| a) | Linear $C_{11.8}$ Alkylbenzene Sulfonate (LAS) | 9.8 |
| b) | Coconut Fatty Alcohol Sulfate (CFAS) | 15.2 |
| c) | Sodium Carbonate | 11.0 |
| d) | Sodium Tripolyphosphate (STPP) | 30.0 |
| e) | Zeolite A (detergent grade, hydrated) | 6.0 |
| f) | Sodium acid pyrophosphate (SAPP) | 3.0 |
| g) | Sodium bicarbonate | 5.0 |
| h) | $A_{45}EO_{7T}$ nonionic | 1.0 |
| i) | $C_{12}$ coconut fatty alcohol (CFA) | 1.0 |
| j) | Miscellaneous (perfumes, brighteners, sulfate, and optional enzymes, soil release agents, etc.) | Balance |

A 280-liter Patterson-Kelly twin shell blender was used.

Pre weigh: Powder raw materials consisting of sodium carbonate, CFAS, sodium tripolyphosphate, a portion of zeolite, sodium sulfate, bicarbonate and sodium acid pyrophosphate are pre weighed and dropped to the V-Blender shell. Liquid raw materials (HLAS acid precursor, nonionic and CFA) are pre-weighed in a tank.

Pre heat: For proper dispersion of the liquid, the liquid should not be viscous. To reduce the viscosity the liquids (such as HLAS, nonionic etc.) are to be preheated to 60°–650° C.

Powder Pre mix: Before injecting liquid, the powder raw materials in the V-Blender are mixed for homogeneity. The pre-mix is done for 2 minutes.

Liquid addition: The preheated liquid is dispersed through the intensifier bar rotating at high RPM. Agglomeration takes place when the dispersed liquid particles mix with the powder raw materials. The liquid addition time is around 8–10 minutes.

Agglomerate Post mix: To improve the agglomerate flow, usually about 1–4% (total composition basis) of zeolite is added after the liquid addition to the V-Blender and operated for 1–2 minutes.

Finished Product: The resultant agglomerated product is handled and packed for sale.

EXAMPLE II

The same compositions shown in Example I are made using instead two mixers in series, in a continuous agglomeration process which makes about 1000 kg/hr of agglomerate.

The powder raw materials such as carbonate, STPP, CFAS, zeolite, bicarbonate and SAPP are feed from the bins through screw conveyors into a CB mixer. The preheated liquid flows from the tank to the mixers. Powder and liquid feed rates are determined by the agglomerate production rate.

About 1–4% (finished product basis) zeolite is added at the KM mixer to aid as a free flow aid. The product from the mixer is conveyed by a vibrating feeder and through bucket elevator to a shifter. Overs (larger particles) are separated, ground and recycled to the agglomerates. The agglomerate goes to a fluid bed cooler and the agglomerates are collected in drums or super sacks.

Agglomerate produced above is mixed with other minor ingredients to produce the detergent product.

The following are additional examples of compositions of the present invention made according to the process of Example I.

EXAMPLES III–VII

| | | Weight % | | | | |
|---|---|---|---|---|---|---|
| | | III | IV | V | VI | VII |
| a) | Linear $C_{12-18}$ Alkylbenzene Sulfonate (LAS) | 13.6 | 12.7 | 0 | 0 | 13.6 |
| b) | Coconut Fatty Alcohol Sulfate (CFAS) | 6.75 | 5.0 | 15.8 | 13.2 | 0 |
| c) | Sodium Carbonate | 8.0 | 5.0 | 0.0 | 5.0 | 5.0 |
| d) | Sodium Tripolyphosphate (STPP) | 15.0 | 10.0 | 5.0 | 10.0 | 0.0 |
| e) | Zeolite A (detergent grade, hydrated) | 6.0 | 5.0 | 3.0 | 5.0 | 2.0 |
| f) | Sodium acid pyrophosphate (SAPP) | 5.0 | 8.0 | 15.0 | 10.0 | 20.0 |
| g) | Sodium bicarbonate | 0.0 | 5.0 | 5.0 | 0.0 | 5.0 |
| h) | $A_{45}EO_{7T}$ nonionic | 1.0 | 1.0 | 1.0 | 1.0 | 1.0 |
| i) | $C_{12}$ coconut fatty alcohol (CFA) | 1.0 | 0.5 | 1.0 | 1.0 | 0.5 |
| j) | Miscellaneous (perfumes, brighteners, sulfate, and optional enzymes, soil release agents, etc.) | Bal. | Bal. | Bal. | Bal. | Bal. |

What is claimed is:

1. A granular detergent composition having a density of 600 gm/liter or above, and having a pH (1% in distilled water) of from about 9.0 to about 10, comprising by weight:

(i) from 13.2% to about 50% detergent anionic surfactant;

(ii) from about 3% to about 40% acid pyrophosphate; and (iii) less than about 1% of citric acid or salt thereof; and (iv) less than about 2% of alkali metal silicate;

(v) an inorganic alkaline material wherein said detergent composition is formed by agglomeration of said acid pyrophosphate, said inorganic alkaline material and a portion of said detergent surfactant and there is substantially no alkali metal silicate present during said agglomeration.

2. The granular detergent composition according to claim 1 wherein said composition is essentially free of said citric acid or salt thereof, and substantially free of alkali metal silicates.

3. The granular detergent composition according to claim 1 wherein said composition is made by an agglomeration process wherein at least a portion of said anionic surfactant is formed by dry neutralization of an acid precursor of said portion of said anionic surfactant with an inorganic alkaline material in the presence of said acid pyrophosphate.

4. A process for making the granular detergent composition according to claim 3 comprising the steps of:

a) forming a particulate mixture comprising a water-soluble carbonate material and said acid pyrophosphate;

b) mixing and shearing the particulate mixture such that the mixture is partially fluidized; and c) dispersing the acid precursor into the partially fluidized particulate mixture, thereby neutralizing the acid precursor to form the detergent composition.

5. The process of claim 4 wherein said particulate mixture of step a) comprises a further portion of said anionic surfactant as alkyl sulfate in particulate form.

6. The process of claim 5 wherein said temperature of said mixture of step b) and said detergent composition of step c) is maintained at a temperature no greater than 80° C.

7. The process of claim 6 wherein said steps are conducted in a V-blender equipment.

* * * * *